US010336067B2

(12) United States Patent
Shimizu et al.

(10) Patent No.: US 10,336,067 B2
(45) Date of Patent: Jul. 2, 2019

(54) LIQUID JET HEAD, LIQUID JET RECORDING DEVICE, AND LIQUID JET HEAD DRIVE METHOD

(71) Applicant: SII Printek Inc., Chiba-shi, Chiba (JP)

(72) Inventors: Takayuki Shimizu, Chiba (JP); Toshiaki Watanabe, Chiba (JP)

(73) Assignee: SII Printek Inc., Chiba-shi (JP)

( * ) Notice: Subject to any disclaimer, the term of this patent is extended or adjusted under 35 U.S.C. 154(b) by 0 days.

(21) Appl. No.: 15/838,854

(22) Filed: Dec. 12, 2017

(65) Prior Publication Data

US 2018/0162125 A1 Jun. 14, 2018

(30) Foreign Application Priority Data

Dec. 13, 2016 (JP) ..... 2016-241327

(51) Int. Cl.
*B41J 2/045* (2006.01)
*B41J 2/14* (2006.01)

(52) U.S. Cl.
CPC ..... *B41J 2/04588* (2013.01); *B41J 2/04581* (2013.01); *B41J 2/04593* (2013.01); *B41J 2/04535* (2013.01); *B41J 2/14201* (2013.01)

(58) Field of Classification Search
CPC . B41J 2/04581; B41J 2/04593; B41J 2/04588
See application file for complete search history.

(56) References Cited

U.S. PATENT DOCUMENTS

| | | | |
|---|---|---|---|
| 2006/0181557 | A1 | 8/2006 | Hoisington et al. |
| 2008/0106557 | A1 | 5/2008 | Sayama |
| 2014/0267481 | A1 | 9/2014 | Menzel |

FOREIGN PATENT DOCUMENTS

| | | | |
|---|---|---|---|
| JP | 2006-069105 | A | 3/2006 |
| JP | 2006-240125 | A | 9/2006 |
| JP | 2009-533253 | A | 9/2009 |
| JP | 2010-149396 | A | 7/2010 |
| JP | 2016-510703 | A | 4/2016 |
| WO | WO 2006/093342 | A1 | 9/2006 |

OTHER PUBLICATIONS

Extended European Search Report in European Application No. 17206728.2 dated Apr. 24, 2018, pp. 1-7.

*Primary Examiner* — Lamson D Nguyen
(74) *Attorney, Agent, or Firm* — Brinks Gilson & Lione

(57) ABSTRACT

An ejection volume of a liquid can more finely be adjusted without lowering the ejection speed. The liquid jet head includes a plurality of nozzles adapted to jet the liquid, a piezoelectric actuator having a plurality of pressure chambers corresponding respectively to the nozzles and filled with the liquid, and adapted to vary a capacity of each of the pressure chambers, and a control section adapted to apply a pulse signal to the piezoelectric actuator to thereby expand and contract the capacity of the pressure chamber so as to jet the liquid with which the pressure chamber is filled. The control section generates a drive waveform including a plurality of the pulse signals adapted to expand the capacity of the pressure chamber, and sets a crest value of either of the pulse signals other than the pulse signal applied last to a different value from a crest value of another of the pulse signals in the drive waveform.

7 Claims, 11 Drawing Sheets

LIQUID JET HEAD, LIQUID JET RECORDING DEVICE, AND LIQUID JET HEAD DRIVE METHOD

RELATED APPLICATIONS

This application claims priority under 35 U.S.C. § 119 to Japanese Patent Application No. 2016-241327 filed on Dec. 13, 2016, the entire content of which are hereby incorporated by reference.

BACKGROUND OF THE INVENTION

Field of the Invention

The present invention relates to a liquid jet head, a liquid jet recording device, and a liquid jet head drive method.

Background Art

A liquid jet recording device equipped with a liquid jet head is used in a variety of fields. In recent years, demands for speeding-up of printing speed have increased, and regarding the liquid jet head, recording heads increased in the number of nozzles or nozzle lines, heads capable of ejecting droplets at high frequency, heads capable of ejecting large-sized droplets, and so on have been put into production.

Further, since a high definition property in the image quality is also required, there has been developed a liquid jet head which increases the grayscale in droplet size (amount of the liquid ejected) and selectively ejects the liquid with the size in the multiple grayscale to thereby cover the range of the droplet size from the small droplet to the large droplet (see, e.g., JP-A-2006-069105 or JP-A-2006-240125). For example, the ejection volume increases in a stepwise manner, like roughly double with 2 drops, roughly triple with 3 drops based on the case of ejecting 1 drop.

However, in the related art, in order to take a value between the grayscales such as a value intermediate between 1 drop and 2 drops, it is necessary to change the parameter (e.g., the pulse width) of the drive waveform. In the case of changing the parameter of the drive waveform, since the ejection speed is also affected significantly, there are problems such as a problem of degradation of image quality and a problem that high-speed ejection can hardly be performed. Therefore, there arises a problem that the ejection volume is inevitably assumed as a fixed value inherent in the head structure, and there is no freedom in the ejection volume.

Therefore, the present invention has been made taking the circumstances described above into consideration, and has an object of providing a liquid jet head, a liquid jet recording device, and a liquid jet drive method each capable of more finely adjusting the ejection volume of the liquid without degrading the ejection speed.

SUMMARY OF THE INVENTION

According to an aspect of the invention, there is provided a liquid jet head including a plurality of nozzles adapted to jet the liquid, a piezoelectric actuator having a plurality of pressure chambers corresponding respectively to the nozzles and filled with the liquid, and adapted to vary a capacity of each of the pressure chambers, and a control section adapted to apply a pulse signal to the piezoelectric actuator to thereby expand and contract the capacity of the pressure chamber so as to jet the liquid with which the pressure chamber is filled, wherein the control section generates a drive waveform including a plurality of the pulse signals adapted to expand the capacity of the pressure chamber, and sets a crest value of either of the pulse signals other than the pulse signal applied last to a different value from a crest value of another of the pulse signals in the drive waveform.

Further, according to another aspect of the invention, in the liquid jet head described above, the control section sets the crest value of either one of the pulse signals to the different value from the crest value of the other of the pulse signals in the drive waveform.

Further, according to another aspect of the invention, in the liquid jet head described above, the control section sets the crest values of two or more of the pulse signals to different values from the crest value of the other of the pulse signals in the drive waveform.

Further, according to another aspect of the invention, in the liquid jet head described above, the control section sets the crest value of the pulse signal applied first to the different value from the crest value of the other of the pulse signals in the drive waveform.

Further, according to another aspect of the invention, in the liquid jet head described above, the control section applies a pulse signal adapted to contract the capacity of the pressure chamber at an end of the drive waveform.

Further, according to another aspect of the invention, there is provided a liquid jet recording device equipped with the liquid jet head described above.

Further, according to still another aspect of the invention, there is provided a liquid jet head drive method including the steps of providing a liquid jet head including a plurality of nozzles adapted to jet the liquid, a piezoelectric actuator having a plurality of pressure chambers corresponding respectively to the nozzles and filled with the liquid, and adapted to vary a capacity of each of the pressure chambers, and a control section adapted to apply a pulse signal to the piezoelectric actuator to thereby expand and contract the capacity of the pressure chamber so as to jet the liquid with which the pressure chamber is filled, generating, by the control section, a drive waveform including a plurality of the pulse signals adapted to expand the capacity of the pressure chamber, setting, by the control section, a crest value of either of the pulse signals other than the pulse signal applied last to a different value from a crest value of another of the pulse signals in the drive waveform, and applying, by the control section, a last pulse signal of the drive waveform.

According to the invention, the ejection volume of the liquid can more finely be adjusted without lowering the ejection speed.

DETAILED DESCRIPTION OF THE INVENTION

Hereinafter, an embodiment of the invention will be described with reference to the drawings.

First Embodiment

Firstly, the first embodiment will be described.

(Liquid Jet Recording Device)

A schematic configuration of a liquid jet recording device according to the present embodiment will be described.

Figure 1:
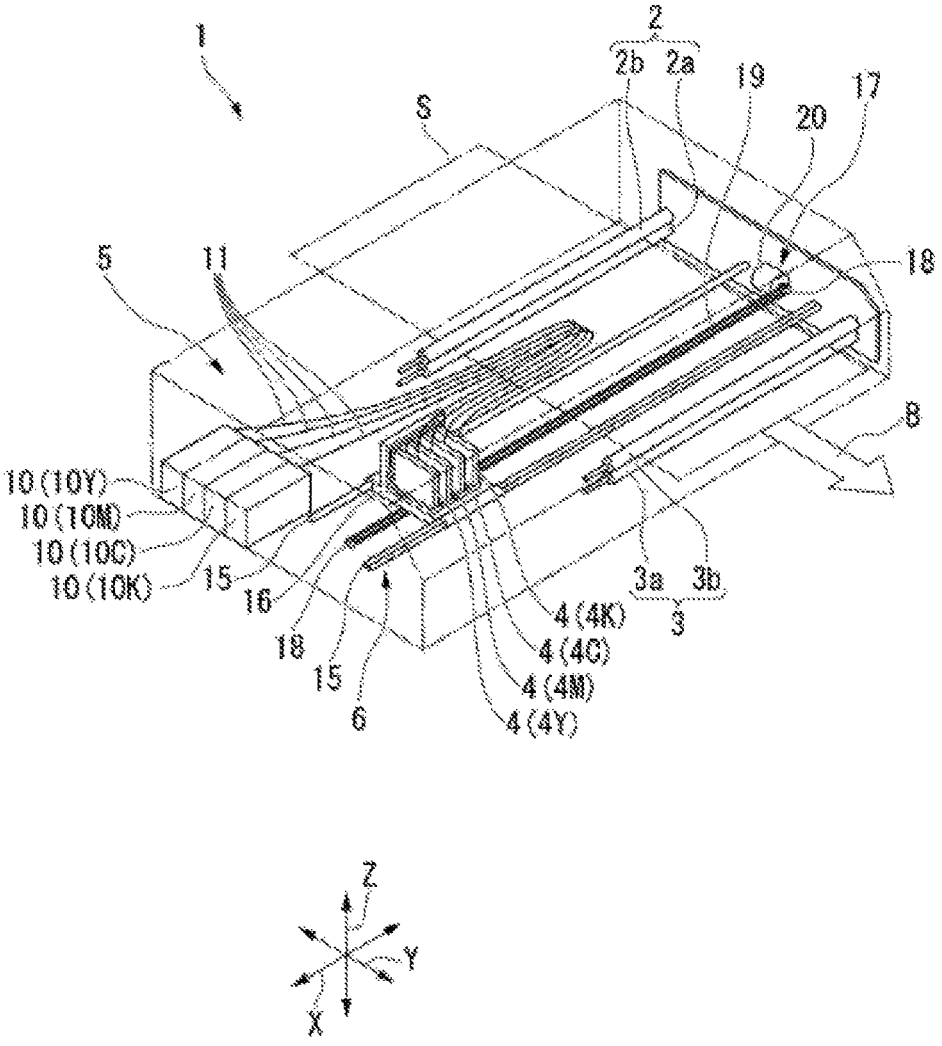
FIG. 1 is a perspective view showing a configuration of a liquid jet recording device according to a first embodiment of the invention.

FIG. 1 is a perspective view showing a configuration of the liquid jet recording device 1. It should be noted that in the drawings described below, the scale size of each member is arbitrarily altered so as to make the explanation easy to understand.

As shown in the drawing, the liquid jet recording device 1 is provided with a pair of conveyers 2, 3 for conveying a recording target medium S such as recording paper, liquid jet heads 4 for ejecting ink not shown to the recording target medium S, an ink supply unit 5 for supplying the liquid jet heads 4 with the ink, and a scanner 6 for making the liquid jet heads 4 perform a scanning operation in a scanning direction X perpendicular to the conveying direction Y of the recording target medium S.

It should be noted that in the present embodiment, the direction perpendicular to the two directions, namely the conveying direction Y and the scanning direction X, is defined as a vertical direction Z.

The pair of conveyers 2, 3 are disposed with a distance in the conveying direction Y, and specifically, the conveyer 2, one of the pair of conveyers, is located on the upstream side in the conveying direction Y, and the conveyer 3, the other of the pair of conveyers, is located on the downstream side in the conveying direction Y. These conveyers 2, 3 are provided with grit rollers 2*a*, 3*a* each extending in the scanning direction X, pinch rollers 2*b*, 3*b* arranged in parallel to the grit rollers 2*a*, 3*a* and for pinching the recording target medium S with the grit rollers 2*a*, 3*a*, and a drive mechanism not shown such as a motor for rotating the grit rollers 2*a*, 3*a* around the respective axes.

Further, by rotating the grit rollers 2*a*, 3*a* of the pair of conveyers 2, 3, it is possible to convey the recording target medium S in the direction of the arrow B along the conveying direction Y.

The ink supply unit 5 is provided with ink tanks 10 each housing the ink, and ink pipes 11 for respectively connecting the ink tanks 10 and the liquid jet heads 4 to each other.

In the example shown in the drawing, as the ink tanks 10, the ink tanks 10Y, 10M, 10C, and 10K respectively housing the ink of four colors of yellow (Y), magenta (M), cyan (C), and black (K) are arranged along the conveying direction Y. The ink pipes 11 are each, for example, a flexible hose having flexibility, and are made capable of following the action (movement) of a carriage 16 for supporting the liquid jet heads 4.

The scanner 6 is provided with a pair of guide rails 15, the carriage 16, and a drive mechanism 17, wherein the pair of guide rails 15 extend in the scanning direction X, and are disposed in parallel to each other with a distance in the conveying direction Y, the carriage 16 is disposed so as to be movable along the pair of guide rails 15, and the drive mechanism 17 moves the carriage 16 in the scanning direction X.

The drive mechanism 17 is provided with a pair of pulleys 18, an endless belt 19, and a drive motor 20, wherein the pair of pulleys 18 are disposed between the pair of guide rails 15 with a distance in the scanning direction X, the endless belt 19 is wound between the pair of pulleys 18, and moves in the scanning direction X, and the drive motor 20 rotationally drives one of the pulleys 18.

The carriage 16 is connected to the endless belt 19, and is made movable in the scanning direction X in accordance with the movement of the endless belt 19 due to the rotational drive of the one of the pulleys 18. Further, on the carriage 16, there is mounted the plurality of liquid jet heads 4 in the state of being arranged in the scanning direction X.

In the example shown in the drawing, there are mounted the four liquid jet heads 4, namely the liquid jet heads 4Y, 4M, 4C, and 4K, for respectively ejecting the ink of four colors of yellow (Y), magenta (M), cyan (C), and black (K).

(Liquid Jet Head)

Then, the liquid jet heads 4 will be described in detail.

Figure 2:
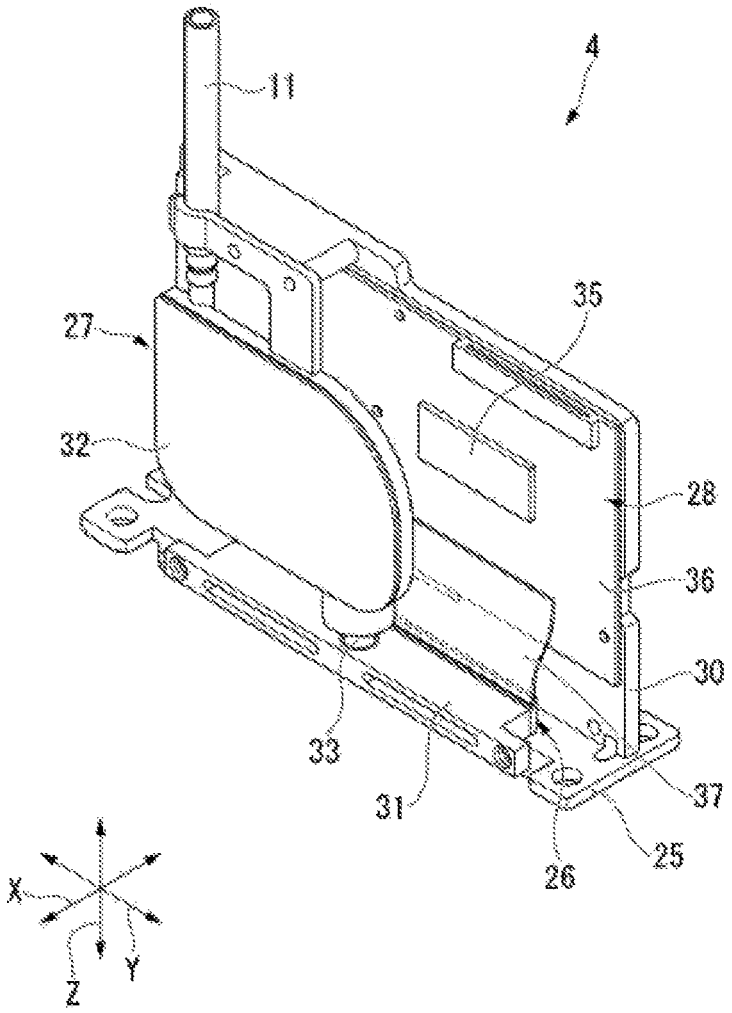
FIG. 2 is a perspective view of a liquid jet head according to the first embodiment of the invention.

FIG. 2 is a perspective view of the liquid jet head 4.

As shown in the drawing, the liquid jet head 4 is provided with a fixation plate 25, a head chip 26, an ink supply section 27, and a control section 28, wherein the fixation plate 25 is fixed to the carriage 16, the head chip 26 is fixed on the fixation plate 25, the ink supply section 27 further supplies an ink introduction hole 41*a* described later of the head chip 26 with the ink having been supplied from the ink supply unit 5, and the control section 28 applies a drive voltage to the head chip 26.

The liquid jet heads 4 eject the ink of the respective colors with predetermined jet amounts in response to the application of the drive voltages. On this occasion, by the scanner 6 moving the liquid jet heads 4 in the scanning direction X, it is possible to perform recording in a predetermined range on the recording target medium S. By repeatedly performing the scanning operation while conveying the recording target medium S in the conveying direction Y by the conveyers 2, 3, it becomes possible to perform recording in the entire area of the recording target medium S.

To the fixation plate 25, there are fixed a base plate 30 made of metal such as aluminum in a state of standing along the vertical direction Z, and a flow channel member 31 for supplying the ink to the ink introduction hole 41*a* described later of the head chip 26. Above the flow channel member 31, there is disposed a pressure damper 32 having a reservoir chamber for reserving the ink inside in a state of being supported by the base plate 30. Further, the flow channel member 31 and the pressure damper 32 are connected to each other via an ink connection pipe 33, and to the pressure damper 32, there is connected the ink pipe 11.

In such a configuration, when the ink is supplied via the ink pipe 11, the pressure damper 32 once reserves the ink in the reservoir chamber located inside the pressure damper 32, and then supplies a predetermined amount of the ink to the ink introduction hole 41*a* via the ink connection pipe 33 and the flow channel member 31.

It should be noted that the flow channel member 31, the pressure damper 32, and the ink connection pipe 33 function as the ink supply section 27 described above.

Further, to the fixation plate 25, there is attached an IC board 36 on which a control circuit 35 such as an integrated circuit for driving the head chip 26 is mounted. The control circuit 35, and a common electrode (a drive electrode) and individual electrodes described later (both not shown) of the head chip 26 are electrically connected via a flexible board 37 having a wiring pattern not shown printed as wiring. Thus, it becomes possible for the control circuit 35 to apply the drive voltage between the common electrode and each of the individual electrodes via the flexible board 37.

It should be noted that the IC board 36, on which the control circuit 35 is mounted, and the flexible board 37 function as the control section 28 described above.

(Head Chip)

Next, the details of the head chip 26 will be described.

Figure 3:
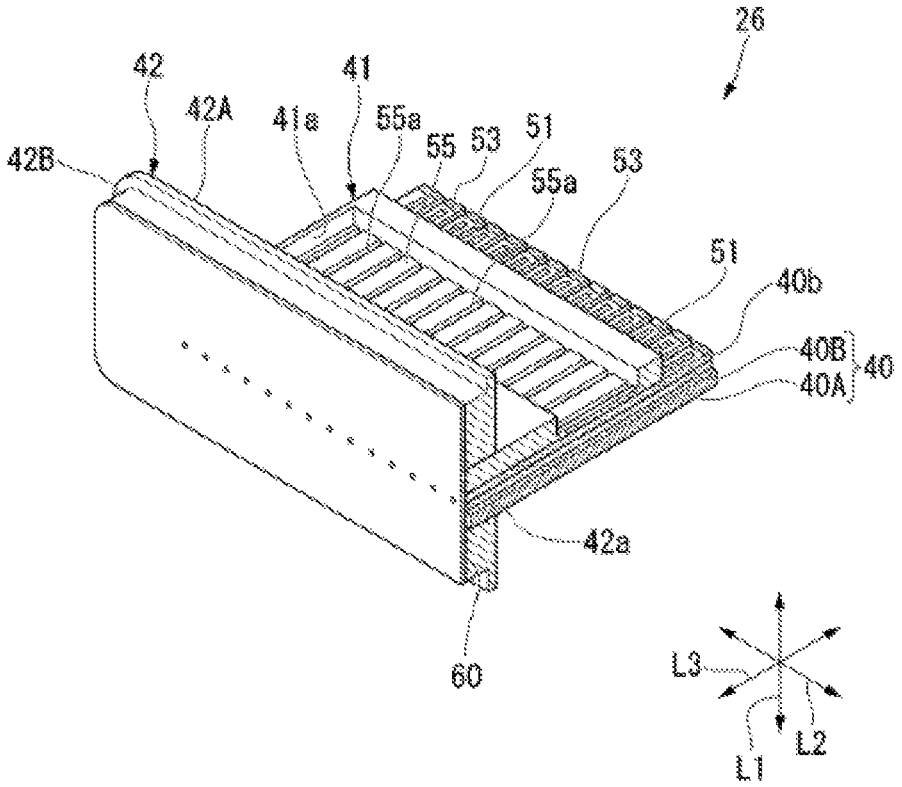
FIG. 3 is a perspective view of a head chip in the first embodiment of the invention.
Figure 4:
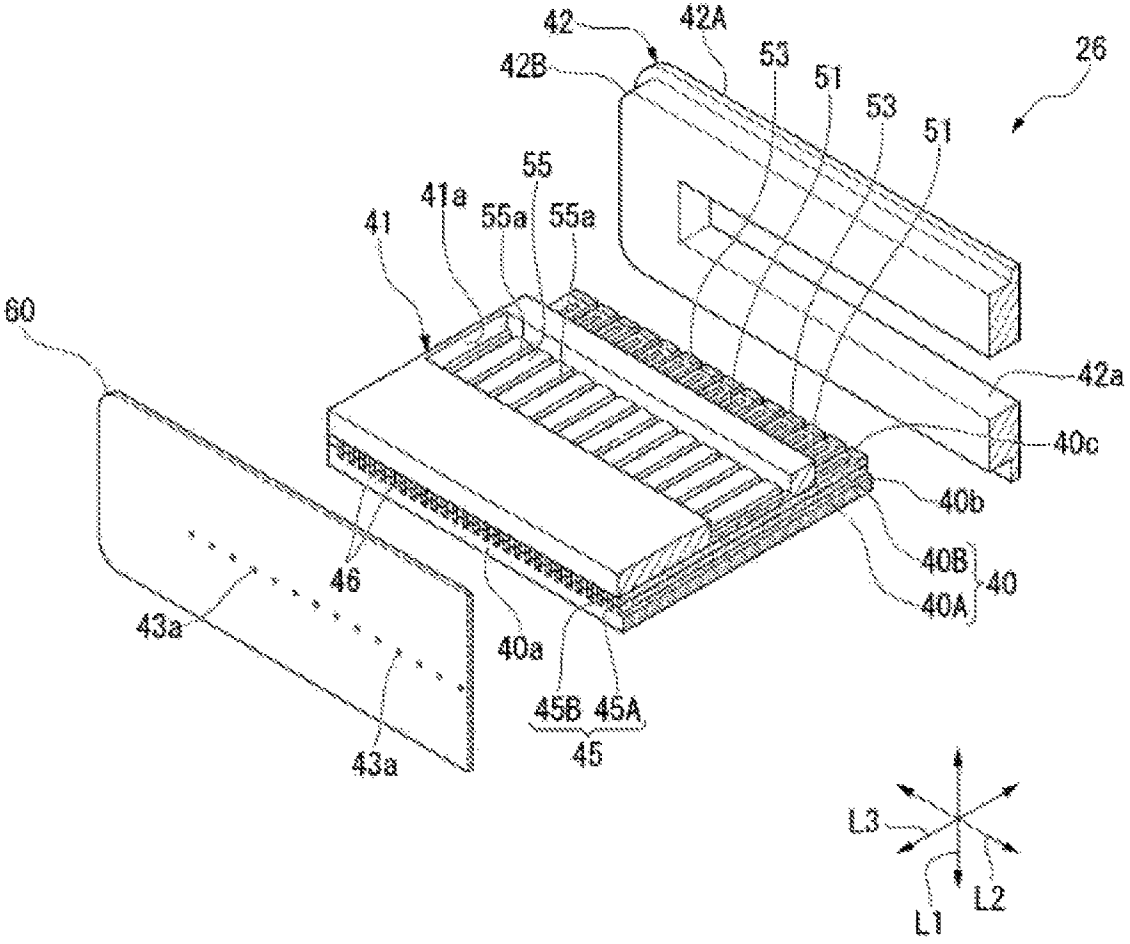
FIG. 4 is an exploded perspective view of the head chip in the first embodiment of the invention.

FIG. 3 is a perspective view of the head chip 26, and FIG. 4 is an exploded perspective view of the head chip 26.

As shown in FIG. 3 and FIG. 4, the head chip 26 is provided with an actuator plate 40, a cover plate 41, a support plate 42, and a nozzle plate 60, wherein the nozzle plate 60 is disposed on a side surface of the actuator plate 40.

The head chip 26 is made as a so-called edge-shoot type for ejecting the ink from a nozzle hole 43*a* opening at the end part in the longitudinal direction of a liquid ejection channel 45A described later.

The actuator plate 40 is made as a so-called laminated plate having two plates, namely a first actuator plate 40A and a second actuator plate 40B, stacked on one another. It should be noted that the actuator plate 40 can also be formed of a single plate besides the laminated plate.

The first actuator plate 40A and the second actuator plate 40B are each a piezoelectric substrate such as a PZT (lead zirconate titanate) ceramics substrate on which a polarization treatment has been performed in the thickness direction, and are bonded to each other in the state in which the respective polarization directions are opposite to each other.

The actuator plate 40 is formed to have a roughly rectangular planar shape longer in a first direction (an arrangement direction) L2 perpendicular to the thickness direction L1 and shorter in a second direction L3 perpendicular to the thickness direction L1 and the first direction L2.

It should be noted that since the head chip 26 of the present embodiment is the edge-shoot type, the thickness direction L1 coincides with the scanning direction X in the liquid jet recording device 1, and at the same time, the first direction L2 coincides with the conveying direction Y, and the second direction L3 coincides with the vertical direction Z. Specifically, out of the side surfaces of the actuator plate 40, for example, the side surface (the side surface located on the side from which the ink is ejected) opposed to the nozzle plate 60 becomes a lower end surface 40*a*, and the side surface located on the opposite side in the second direction L3 to the lower end surface 40*a* becomes an upper end surface 40*b*. In the following description, the description is presented with the simple references of "lower side" and "upper side" in some cases based on the upper and lower directions described here. However, normally, it goes without saying that the upper and lower directions vary in accordance with the installation angle of the liquid jet recording device 1.

On one principal surface (a surface overlapped by the cover plate 41) 40*c* of the actuator plate 40, there is formed a plurality of channels 45 arranged in the first direction L2 with predetermined distances. The channels 45 are each a groove linearly extending along the second direction L3 in the state of opening on one principal surface 40*c* side, and one side in the longitudinal direction of each of the channels 45 opens on the lower end surface 40*a* side of the actuator plate 40. Between these channels 45, there are formed drive walls (piezoelectric division walls) 46 each having a roughly rectangular cross-sectional shape and extending in the second direction L3. The channels 45 are partitioned by the drive walls 46.

Further, the plurality of channels 45 is roughly divided into liquid ejection channels 45A filled with the ink, and non-ejection channels 45B not filled with the ink. Further, the liquid ejection channels 45A and the non-ejection channels 45B are arranged alternately in the first direction L2.

Among these channels, the liquid ejection channels 45A are each formed in the state of opening only on the lower end surface 40*a* side of the actuator plate 40 without opening on the upper end surface 40*b* side. In contrast, the non-ejection channels 45B are each formed so as to open not only on the lower end surface 40*a* side of the actuator plate 40, but also on the upper end surface 40*b* side.

On inner wall surfaces, namely a pair of sidewall surfaces opposed to each other in the first direction L2, and the bottom wall surface of each of the liquid ejection channels 45A, there is formed the common electrode not shown. The common electrode extends in the second direction L3 along the liquid ejection channel 45A, and is electrically connected to a common terminal 51 formed on the one principal surface 40*c* of the actuator plate 40.

In contrast, among inner wall surfaces of the non-ejection channels 45B, on a pair of sidewall surfaces opposed to each other in the first direction L2, there are respectively formed the individual electrodes not shown. These individual electrodes extend in the second direction L3 along the non-ejection channel 45B, and are electrically connected respectively to individual terminals 53 formed on the one principal surface 40*c* of the actuator plate 40.

It should be noted that the individual terminals 53 are formed on the upper end surface 40*b* side of the common terminal 51 on the one principal surface 40*c* of the actuator plate 40. Further, the individual electrodes (the individual electrodes respectively formed in the non-ejection channels 45B different from each other) respectively located on both sides across the liquid ejection channel 45A are formed so as to be connected to each other.

In such a configuration, when the control circuit 35 applies the drive voltage between the common electrode and the individual electrode via the flexible board 37 and further through the common terminal 51 and the individual terminal 53, the drive walls 46 are deformed. Then, a pressure variation occurs in the ink with which the liquid ejection channel 45A is filled. Thus, it is possible to eject the ink in the liquid ejection channel 45A from the nozzle hole 43*a*, and it becomes possible to record a variety of types of information such as characters or figures on the recording target medium S.

On the one principal surface 40*c* of the actuator plate 40, there is overlapped the cover plate 41. In the cover plate 41, there is formed the ink introduction hole 41*a* having a roughly rectangular planar shape elongated in the first direction L2.

In the ink introduction hole 41*a*, there is formed an ink introduction plate 55 provided with a plurality of slits 55*a* for introducing the ink supplied via the flow channel member 31 into the liquid ejection channels 45A and at the same time restricting the introduction of the ink into the non-ejection channels 45B. Specifically, the slits 55*a* are formed at positions corresponding respectively to the liquid ejection channels 45A, and it becomes possible to fill only the liquid ejection channels 45A with the ink.

It should be noted that the cover plate 41 is formed of, for example, a PZT ceramics substrate, which is the same material as that of the actuator plate 40, to thereby achieve the same thermal expansion as that of the actuator plate 40, and thus the warpage and the deformation due to the change in temperature are prevented. It should be noted that the invention is not limited to this case, but it is also possible to form the cover plate 41 with a material different from that of the actuator plate 40. In this case, it is preferable to use a material close in thermal expansion coefficient to the actuator plate 40 as the material of the cover plate 41.

The support plate 42 supports the actuator plate 40 and the cover plate 41 overlapped with each other, and at the same time supports the nozzle plate 60. The support plate 42 is a plate member having a roughly rectangular shape elongated in the first direction L2 so as to correspond to the actuator plate 40, and is provided with a fitting hole 42*a* penetrating in the thickness direction formed in most of the central portion. The fitting hole 42*a* is formed along the first direction L2 so as to have a roughly rectangular shape, and supports the actuator plate 40 and the cover plate 41 overlapped with each other in the state of fitting in the fitting hole 42*a*.

Further, the support plate 42 is formed to have a stepped plate shape so that the outer shape of the support plate 42 decreases toward the lower end in the thickness direction due to the step. In other words, the support plate 42 is obtained by integrally molding a base part 42A located on the upper end side in the thickness direction, and a step part 42B disposed on the lower end surface of the base part 42A and formed to have a smaller outer shape than that of the base part 42A. Further, the support plate 42 is combined so that the end surface of the step part 42B is coplanar with the lower end surface 40*a* of the actuator plate 40. Further, to the end surface of the step part 42B, there is fixed the nozzle plate 60 with, for example, an adhesive.

(Control Section)

Figure 5:
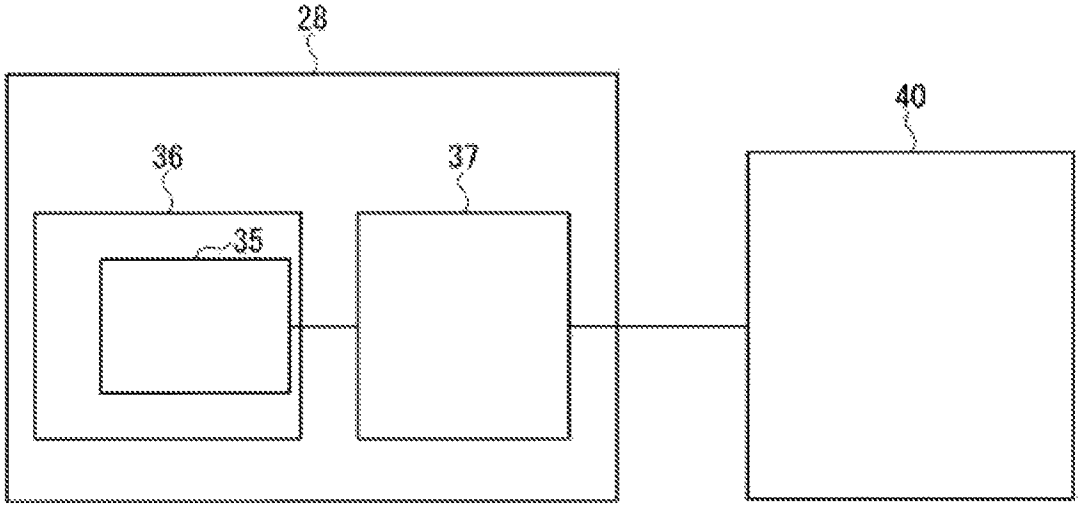
FIG. 5 is a schematic block diagram showing an example of a control section in the first embodiment of the invention.

Next, the control section 28 will be described in detail. FIG. 5 is a schematic block diagram showing an example of the control section 28. As shown in this drawing, in the control section 28, the control circuit 35 mounted on the IC board 36 is electrically connected to the common electrode and the individual electrodes respectively via the flexible board 37, and further through the common terminal 51 and the individual terminals 53 of the actuator plate 40.

The control circuit 35 applies the drive voltage (a pulse signal) between the common electrode and each of the individual electrodes of the actuator plate 40. Thus, the drive walls 46 deform to expand and contract the capacity in the liquid ejection channel 45A (the pressure chamber), and the ink (the liquid) with which the liquid ejection channel 45A is filled is ejected from the nozzle hole 43*a*.

Here, the control circuit 35 applies a positive pulse signal (an expansion pulse signal) with a positive drive voltage between the common electrode and the individual electrode to thereby expand the capacity of the liquid ejection channel 45A. Further, the control circuit 35 applies a negative pulse signal (a contraction pulse signal) with a negative drive voltage between the common electrode and the individual electrode to thereby contract the capacity of the liquid ejection channel 45A.

Further, the control circuit 35 is provided with a plurality types of drive waveforms for varying the ejection volume of the droplet (the droplet size) by applying the positive pulse signal once or a plurality of times. In other words, the control circuit 35 can selectively eject the droplet from the droplet sizes in a multiple grayscale. Thus, it is possible to cover the range of the droplet size from the small droplet to the large droplet to make the image quality high-definition.

The droplet size, namely the ejection volume of the droplet (the ink) to be ejected from the nozzle hole 43*a*, varies in accordance with the number of times that the positive pulse signal is applied. For example, in the case in which the crest values (the drive voltages) of all of the positive pulse signals to be applied are the same voltage, the ejection volume in the case of applying the positive pulse signal twice is roughly double the amount in the case of applying the positive pulse signal once. Similarly, in the case in which the crest values of all of the positive pulse signals to be applied are the same voltage, the ejection volume in the case of applying the positive pulse signal n (n is a positive integer) times is roughly n times the amount in the case of applying the positive pulse signal once. The description will hereinafter be presented defining the ejection volume of the ink in the drive waveform of applying once the positive pulse signal with the same voltage as 1 drop. In other words, in the following example, the ejection volume in the case of applying the positive pulse signal with the same voltage n times is n drops.

Figure 6:
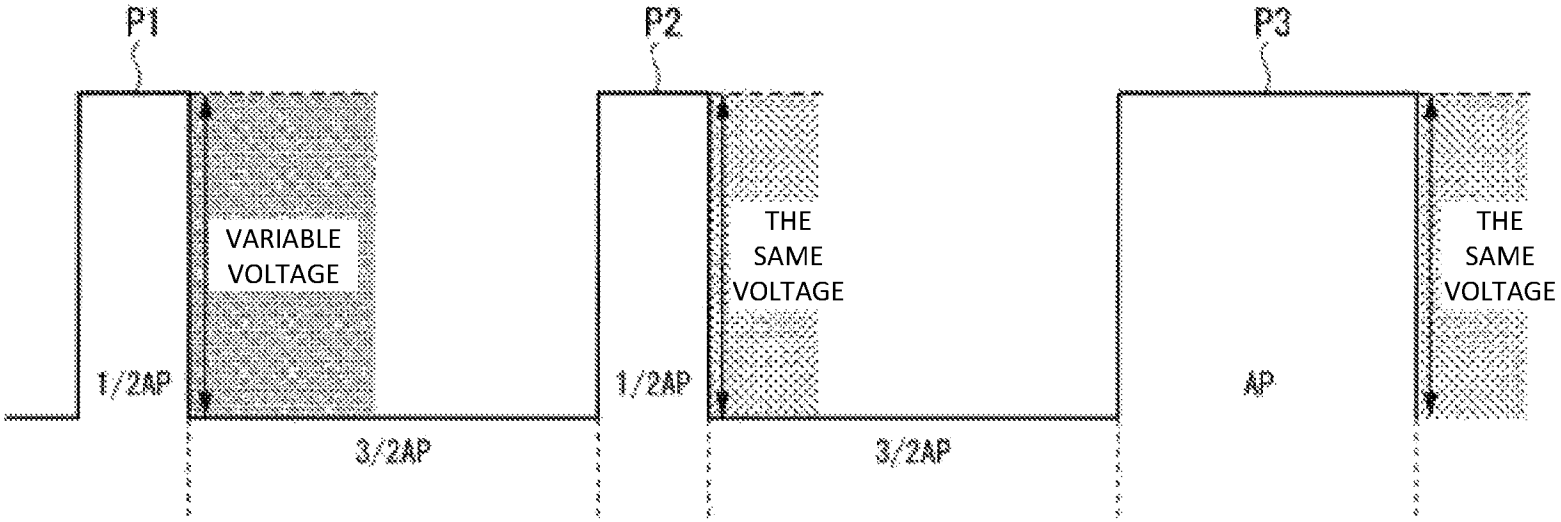
FIG. 6 is a diagram showing an example of a drive waveform output by a control circuit in the first embodiment of the invention.

FIG. 6 is a diagram showing an example of the drive waveform output by the control circuit 35.

In the present diagram, the horizontal axis represents time. Further, in the present diagram, there is shown the drive waveform of applying the positive pulse signal three times.

In the example shown in the present diagram, the control circuit 35 firstly applies a first positive pulse signal P1 with the pulse width of ½ AP (on-pulse peak), then applies a second positive pulse signal P2 with the pulse width of ½ AP after 3/2 AP elapses, and then applies the last positive pulse signal P3 with the pulse width of AP double the width of the first positive pulse signal P1 and the second positive pulse signal P2 after 3/2 AP elapses. The on-pulse peak is the concept in which a half of the natural vibration period of the ink in the liquid ejection channel 45A (the pressure chamber) is defined as 1 AP with respect to the liquid jet head 4 having the liquid ejection channel 45A (the pressure chamber) for containing the ink, the nozzle hole 43*a* communicated with the liquid ejection channel 45A and for jetting the ink in the liquid ejection channel 45A, and the actuator plate 40 for expanding or contracting the capacity of the liquid ejection channel 45A.

Here, the control circuit 35 changes the crest value of the first positive pulse signal P1 to a different value from those of the rest of the positive pulse signals to thereby vary the ejection volume of the ink in a range between 2 drops and 3 drops. It should be noted that the crest values of the second positive pulse signal P2 and the third positive pulse signal P3 are the same voltage (e.g., 25 V (volts)).

Figure 7A:
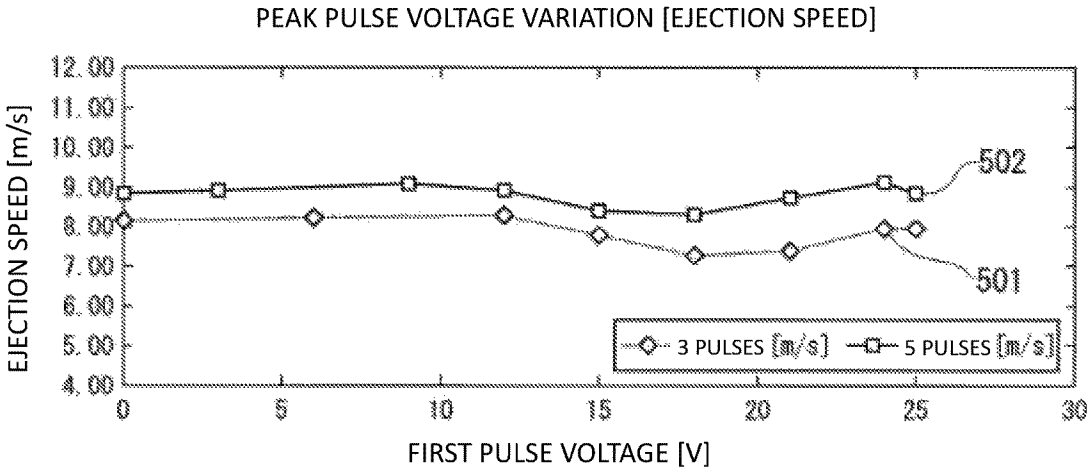
FIGS. 7A and 7B are graphs showing an experimental result when varying the crest value of a first positive pulse signal in the first embodiment of the invention.
Figure 7B:
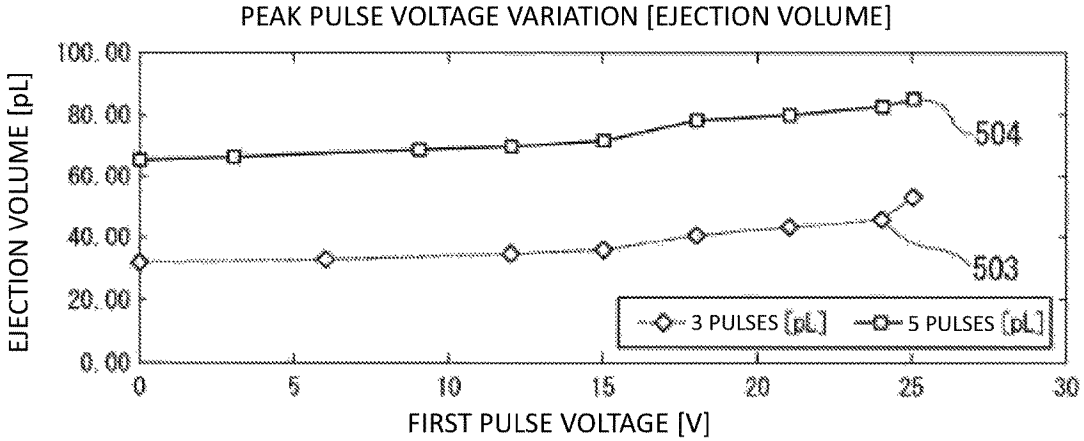

FIGS. 7A and 7B are graphs showing an experimental result when varying the crest value of the first positive pulse signal. In the present diagrams, there is shown the experimental result obtained when varying the crest value (the first pulse voltage) of the first positive pulse signal to be applied first from 0 V to 25 V in the case of applying the positive pulse signal three times and in the case of applying the positive pulse signal five times.

FIG. 7A is a graph showing the relationship between the crest value (the first pulse voltage in volts) of the first positive pulse signal and the ejection speed (in m/s (meter per second)) of the ink. In the present diagram, the horizontal axis represents the crest value (the first pulse voltage), and the vertical axis represents the election speed. Further, the solid line 501 represents the variation in the case of applying the positive pulse signal three times, and the solid line 502 represents the variation in the case of applying the positive pulse signal five times.

As shown in the drawing, in either of the cases, namely the case of applying the positive pulse signal three times and the case of applying the positive pulse signal five times, the ejection speed of the ink is roughly constant even when varying the crest value of the first positive pulse signal.

FIG. 7B is a graph showing the relationship between the crest value (the first pulse voltage in volts) of the first positive pulse signal and the ejection volume (in pL (picoliter)) of the ink. In the present diagram, the horizontal axis represents the crest value (the first pulse voltage), and the vertical axis represents the election amount. Further, the solid line 503 represents the variation in the case of applying the positive pulse signal three times, and the solid line 504 represents the variation in the case of applying the positive pulse signal five times.

As shown in the drawing, in either of the cases, namely the case of applying the positive pulse signal three times and the case of applying the positive pulse signal five times, the ejection volume of the ink increases as the crest value of the first positive pulse signal increases, and decreases as the crest value decreases. Therefore, by varying the crest value of the first positive pulse signal, the control circuit 35 can adjust the ejection volume of the ink to a fractional value between "drops" without lowering the ejection speed.

As described hereinabove, the liquid jet recording device 1 according to the present embodiment is equipped with the liquid jet heads 4 each characterized by including the plurality of nozzle holes 43*a* for jetting the liquid, the actuator plate 40 having the plurality of liquid ejection channels 45A corresponding respectively to the nozzle holes 43*a* and filled with the liquid, and varying the capacities of the liquid ejection channels 45A, and the control circuit 35 for applying the pulse signals to the actuator plate 40 to thereby expand and contract the capacities of the liquid ejection channels 45A to jet the liquid with which the liquid ejection channels 45A are filled, wherein the control circuit 35 generates the drive waveform for applying the pulse signal for expanding the capacity of the liquid ejection channel 45A a plurality of times, and sets the crest value of the pulse signal applied first to a different value from those of the rest of the pulse signals.

Thus, it is possible to adjust the ejection volume of the liquid to a fractional value between "drops" without changing the structure of the liquid jet head 4 or the pulse width. Therefore, it is possible to adjust the ejection volume of the liquid to a fractional value between "drops" without changing the structure of the liquid jet head 4, and without lowering the ejection speed.

Second Embodiment

Subsequently, a second embodiment will be described. The configuration of the liquid jet recording device 1 according to the present embodiment is substantially the same as in the first embodiment, and therefore, the description thereof will be omitted. The present embodiment is different from the first embodiment in the point that the control circuit 35 applies a negative pulse signal at the end of the drive waveform. The rest of the configuration is substantially the same as in the first embodiment, and therefore, the description thereof will be omitted.

Figure 8:
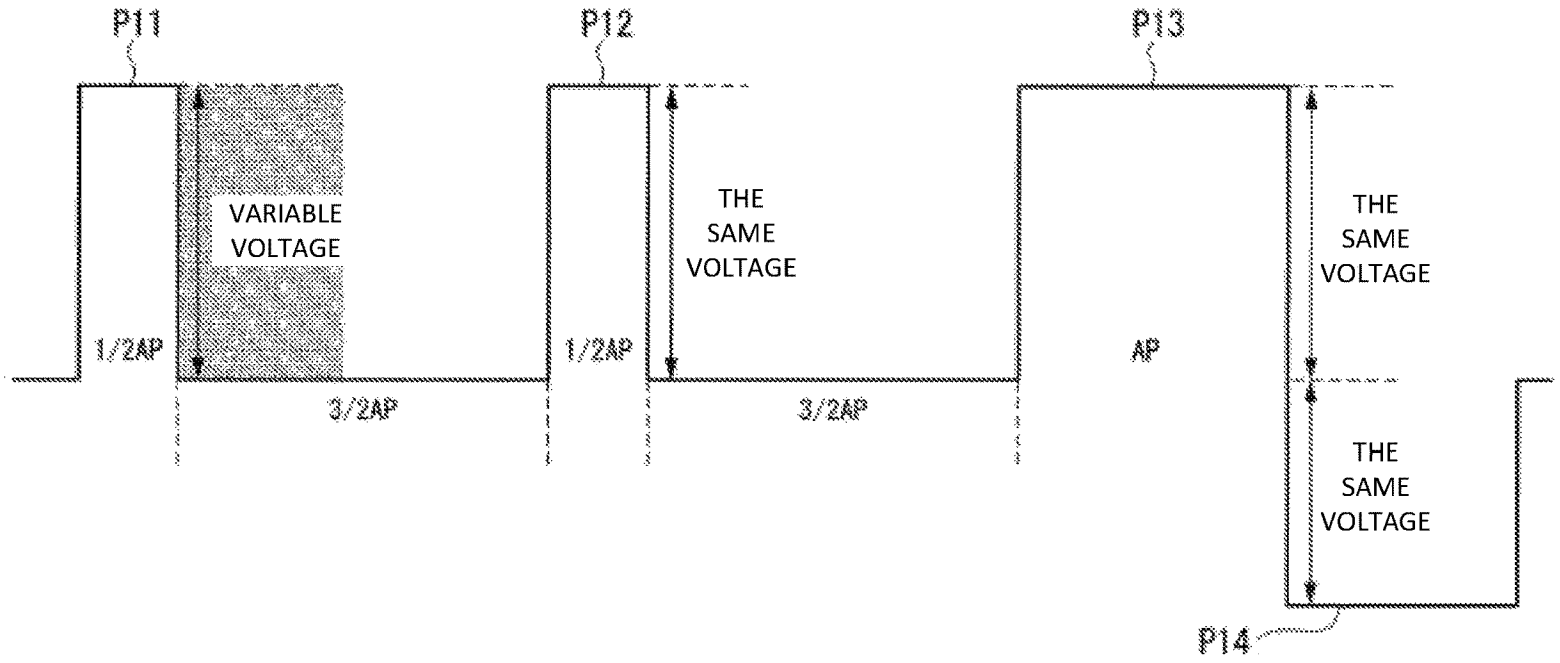
FIG. 8 is a diagram showing an example of a drive waveform output by a control circuit in a second embodiment of the invention.

FIG. 8 is a diagram showing an example of the drive waveform output by the control circuit 35.

In the present diagram, the horizontal axis represents time. Further, in the present diagram, there is shown the drive waveform of applying the positive pulse signal three times.

In the example shown in the present diagram, the control circuit 35 firstly applies a first positive pulse signal P11 with the pulse width of ½ AP, then applies a second positive pulse signal P12 with the pulse width of ½ AP after 3/2 AP elapses, then applies the last positive pulse signal P13 with the pulse width of AP double the width of the first positive pulse signal P11 and the second positive pulse signal P12 after 3/2 AP elapses, and then applies a negative pulse signal P14 immediately after the positive pulse signal P13. Here, the control circuit 35 changes the crest value of the first positive pulse signal P11 to a different value from those of the rest of the positive pulse signals to thereby vary the ejection volume of the ink in a range between 2 drops and 3 drops. It should be noted that the crest values of the second positive pulse signal P12, the third positive pulse signal P13, and the negative pulse signal P14 are the same voltage (e.g., 20 V). It should be noted that the crest value of the negative pulse signal P14 can be the same as, or different from that of the positive pulse signal P13.

The negative pulse signal is a pulse signal for contracting the capacity of the liquid ejection channel 45A to thereby jet the plurality of ink droplets, which have been discharged from the nozzle hole 43*a* by the positive pulse signals (i.e., expansion of the capacity of the liquid ejection channel 45A) applied in the posterior stage, with higher pressure. As described above, by applying the negative pulse signal as the final applied pulse signal in the drive waveform, it is possible to contract the capacity of the liquid ejection channel 45A to thereby jet the ink droplet with higher pressure, and therefore, the crest value of the positive pulse signal can be set lower compared to the case of not applying the negative pulse signal at the end. For example, the crest value can be held down to 20 V. Further, by applying the negative pulse signal, it is possible to improve the ejection speed with respect to the ejection volume, namely the ejection efficiency, of the droplet.

Figure 9A:
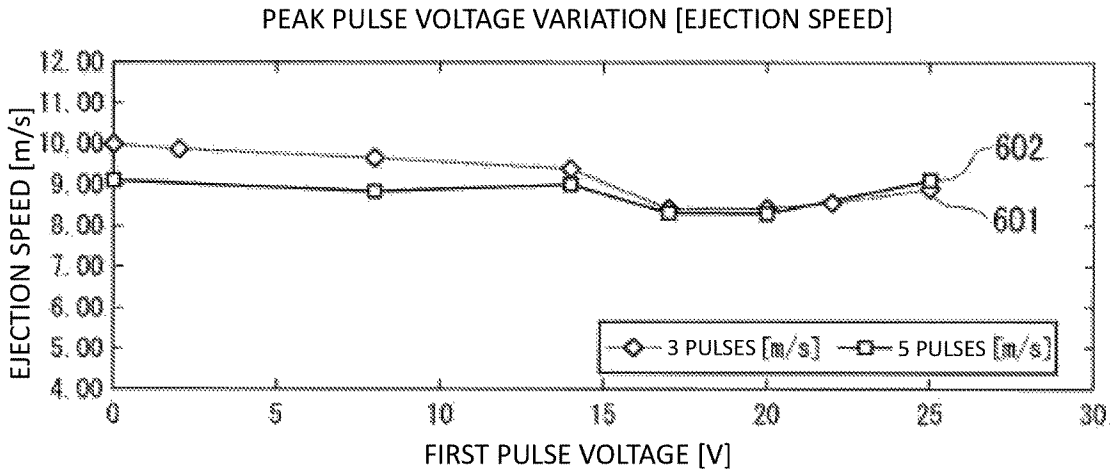
FIGS. 9A and 9B are graphs showing an experimental result when varying the crest value of a first positive pulse signal in the second embodiment of the invention.
Figure 9B:
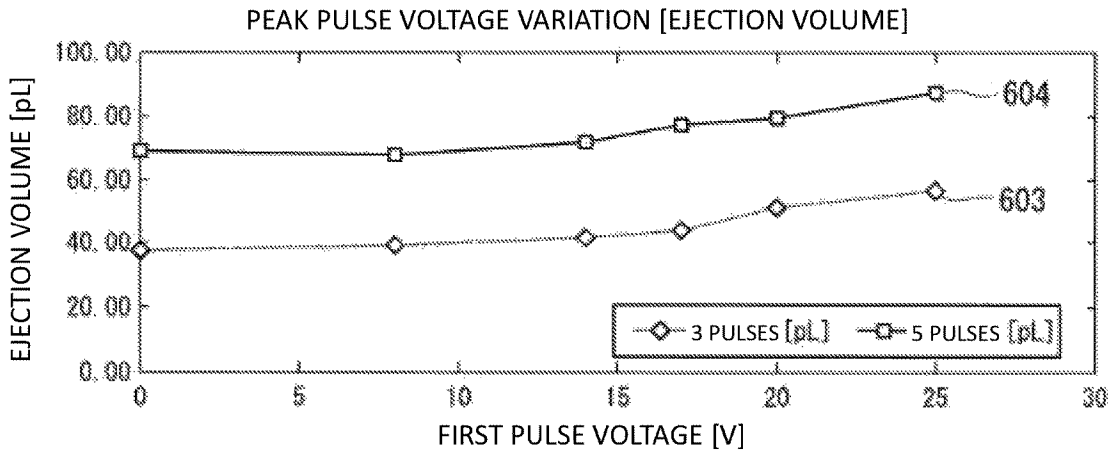

FIGS. 9A and 9B are graphs showing an experimental result when changing the crest value of the first positive pulse signal. In the present diagrams, there is shown the experimental result obtained when varying the crest value of the first positive pulse signal to be applied first from 0 V to 25 V in the case of applying the positive pulse signal three times and in the case of applying the positive pulse signal five times in the drive waveform of applying the negative pulse signal at the end.

FIG. 9A is a graph showing the relationship between the crest value (the first pulse voltage in volts) of the first positive pulse signal and the ejection speed (in m/s) of the ink. In the present diagram, the horizontal axis represents the crest value (the first pulse voltage), and the vertical axis represents the election speed. Further, the solid line 601 represents the variation in the case of applying the positive pulse signal three times, and the solid line 602 represents the variation in the case of applying the positive pulse signal five times.

As shown in the drawing, in either of the cases, namely the case of applying the positive pulse signal three times and the case of applying the positive pulse signal five times, the ejection speed of the ink is roughly constant even when varying the crest value of the first positive pulse signal.

FIG. 9B is a graph showing the relationship between the crest value (the first pulse voltage in volts) of the first positive pulse signal and the ejection volume (in pL) of the ink. In the present diagram, the horizontal axis represents the crest value (the first pulse voltage), and the vertical axis represents the election amount. Further, the solid line 603 represents the variation in the case of applying the positive pulse signal three times, and the solid line 604 represents the variation in the case of applying the positive pulse signal five times.

As shown in the drawing, in either of the cases, namely the case of applying the positive pulse signal three times and the case of applying the positive pulse signal five times, the ejection volume of the ink increases as the crest value of the first positive pulse signal increases, and decreases as the crest value decreases. Therefore, even in the case of applying the negative pulse signal at the end of the drive waveform, by varying the crest value of the first positive pulse signal, the control circuit 35 can adjust the ejection volume of the ink to a fractional value between "drops" without lowering the ejection speed.

As described hereinabove, the liquid jet recording device 1 according to the present embodiment is provided with the configuration in the first embodiment, and in addition, the control circuit 35 applies the pulse signal for contracting the capacity of the liquid ejection channel 45A at the end of the drive waveform. Thus, even in the case of applying the pulse signal for contracting the capacity of the liquid ejection channel 45A, it is possible to adjust the ejection volume of the liquid to a fractional value between "drops" and at the same time improve the ejection efficiency without changing the structure of the liquid jet head 4 or the pulse width.

Third Embodiment

Next, a third embodiment will be described. The configuration of the liquid jet recording device 1 according to the present embodiment is substantially the same as in the first embodiment, and therefore, the description thereof will be omitted. In the first embodiment, the control circuit 35 varies the crest value of the first positive pulse signal applied at the start of the drive waveform. The present embodiment is different in the point that the crest value of an arbitrary positive pulse signal other than the positive pulse signal applied at the end is varied.

The control circuit 35 in the present embodiment changes the crest value of arbitrary one of the positive pulse signals other than the positive pulse signal applied at the end to a different value from those of the rest of the positive pulse signals to thereby vary the ejection volume of the ink. The rest of the configuration is substantially the same as in the first embodiment, and therefore, the description thereof will be omitted.

Figure 10:
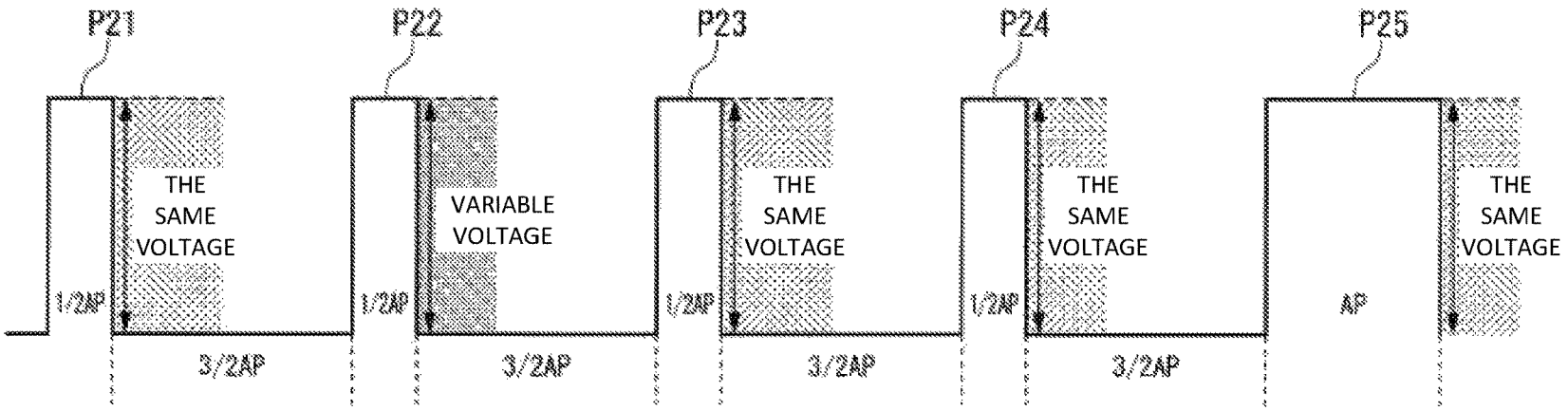
FIG. 10 is a diagram showing an example of a drive waveform output by a control circuit in a third embodiment of the invention.

FIG. 10 is a diagram showing an example of the drive waveform output by the control circuit 35.

In the present diagram, the horizontal axis represents time. Further, in the present diagram, there is shown the drive waveform of applying the positive pulse signal five times.

In the example shown in the present diagram, the control circuit 35 firstly applies a first positive pulse signal P21 with the pulse width of ½ AP, then applies a second positive pulse signal P22 with the pulse width of ½ AP after 3/2 AP elapses, then applies a third positive pulse signal P23 with the pulse width of ½ AP after 3/2 AP elapses, then applies a fourth positive pulse signal P24 with the pulse width of ½ AP after 3/2 AP elapses, then applies the last positive pulse signal P25 with the pulse width of AP double the width of the first through fourth positive pulse signals P21 through P24 after 3/2 AP elapses.

Here, the control circuit 35 changes the crest value of the second positive pulse signal P22 to a different value from those of the rest of the positive pulse signals to thereby vary the ejection volume of the ink in a range between 4 drops and 5 drops. It should be noted that the crest values of the first and third through fifth positive pulse signals P21, P23 through P25 are the same voltage (e.g., 20 V).

Figure 11A:
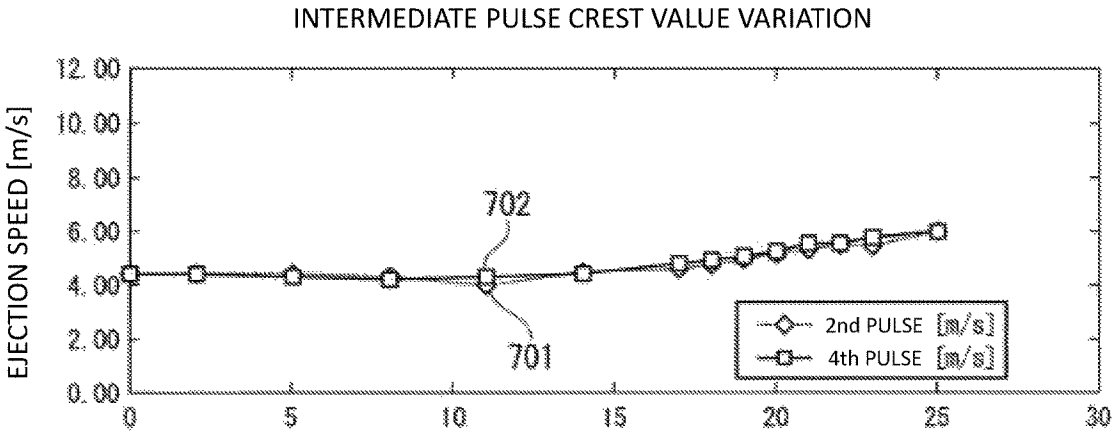
FIGS. 11A and 11B are graphs showing an experimental result when varying the crest value of an arbitrary positive pulse signal in the third embodiment of the invention.
Figure 11B:
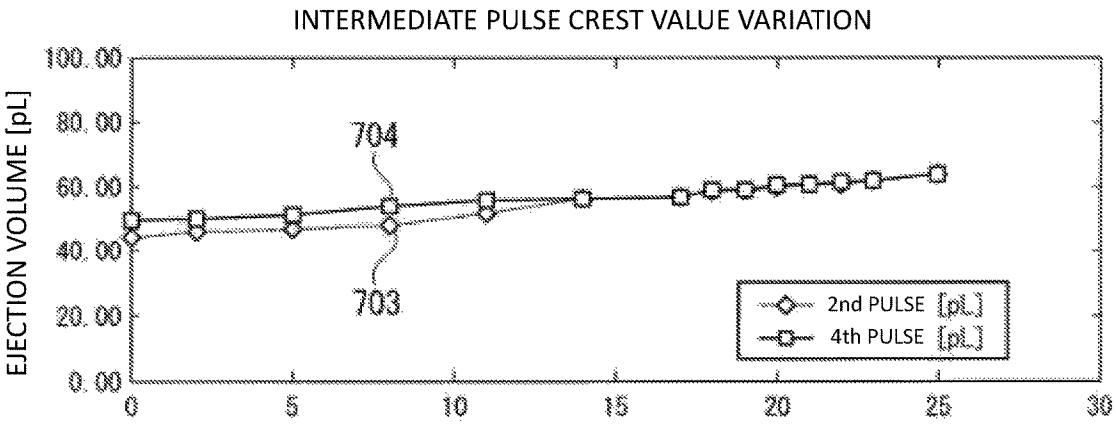

FIGS. 11A and 11B are graphs showing an experimental result when changing the crest value of the arbitrary positive pulse signal. In the present diagrams, there is shown the experimental result when varying the crest value of the second positive pulse signal from 0 V to 25 V, and when varying the crest value of the fourth positive pulse signal from 0 V to 25 V in the case of applying the positive pulse signal five times.

FIG. 11A is a graph showing the relationship between the crest value (the voltage in volts) and the ejection speed (in m/s) of the ink. In the present diagram, the horizontal axis represents the crest value (the voltage), and the vertical axis represents the ejection speed. Further, the solid line 701 represents the variation in the case of varying the crest value of the second positive pulse signal, and the solid line 702 represents the variation in the case of varying the crest value of the fourth positive pulse signal.

As shown in the drawing, even in the case of varying the crest value of either of the second and fourth positive pulse signals, the ejection speed of the ink is roughly constant.

FIG. 11B is a graph showing the relationship between the crest value (the voltage in volts) and the ejection volume (in pL) of the ink. In the present diagram, the horizontal axis represents the crest value (the voltage), and the vertical axis represents the ejection volume. Further, the solid line 703 represents the variation in the case of varying the crest value of the second positive pulse signal, and the solid line 704 represents the variation in the case of varying the crest value of the fourth positive pulse signal.

As shown in the drawing, the ejection volume of the ink increases as the crest value of the second or fourth positive pulse signal increases, and decreases as the crest value decreases. It should be noted that although in the present diagram, there is shown the example of varying the crest value of the second or fourth positive pulse signal, it is also possible for the control circuit 35 to vary the crest value of the first or third positive pulse signal. Therefore, by varying the crest value of the arbitrary positive pulse signal other than the last positive pulse signal, the control circuit 35 can adjust the ejection volume of the ink to a fractional value between "drops" without lowering the ejection speed.

As described hereinabove, the liquid jet recording device 1 according to the present embodiment is equipped with the liquid jet heads 4 each characterized by including the plurality of nozzle holes 43*a* for jetting the liquid, the actuator plate 40 having the plurality of liquid ejection channels 45A corresponding respectively to the nozzle holes 43*a* and filled with the liquid, and capable of varying the capacities of the liquid ejection channels 45A, and the control circuit 35 for applying the pulse signals to the actuator plate 40 to thereby expand and contract the capacities of the liquid ejection channels 45A to jet the liquid with which the liquid ejection channels 45A are filled, wherein the control circuit 35 generates the drive waveform for applying the pulse signal for expanding the capacity of the liquid ejection channel 45A a plurality of times, and sets the crest value of either one of the pulse signals other than the pulse signal to be applied at the end to a different value from those of the rest of the pulse signals.

Thus, it is possible to adjust the ejection volume of the liquid to a fractional value between "drops" without changing the structure of the liquid jet head 4 or the pulse width. Therefore, it is possible to adjust the ejection volume of the liquid to a fractional value between "drops" without changing the structure of the liquid jet head 4, and without lowering the ejection speed.

Although the embodiments of the invention are hereinabove described, the present invention is not limited to the embodiments described above, but a variety of modifications can be made within the scope or the spirit of the invention.

For example, in the embodiments described above, there is described the case in which the head chip 26 is made as a so-called edge-shoot type for ejecting the ink from the nozzle holes 43*a* opening at the end part in the longitudinal direction of the liquid ejection channel 45A. However, the invention is not limited to this configuration, but it is also possible to apply the configuration of the embodiments described above to a so-called side-shooting type head chip for ejecting the ink from nozzle holes opening in the middle in the longitudinal direction of the liquid ejection channels 45A. Further, the liquid jet head 4 can also be a circulating liquid jet head for refluxing the ink supplied to each of the liquid ejection channels 45A to the reservoir chamber of the pressure damper 32, or can also be a non-circulating liquid jet head.

Further, in the embodiments described above, there is explained the liquid jet recording device 1 for moving the pair of conveyers 2, 3 for conveying the recording target medium S such as recording paper and the scanner 6 for performing scanning with the liquid jet heads 4 in the scanning direction X perpendicular to the conveying direction Y of the recording target medium S to perform recording. However, instead thereof, it is also possible to adopt a liquid jet recording device for two-dimensionally moving the recording target medium with the moving mechanism while fixing the scanner 6 to perform recording. In other words, it is sufficient for the moving mechanism to move the liquid jet head and the recording target medium relatively to each other.

Further, in the embodiments described above, the droplet size in the drive waveform of applying the positive pulse signal with a certain voltage once is defined as 1 drop. However, the droplet size and the number of times that the positive pulse signal is used are not required to be the same. For example, it is also possible to add a positive pulse signal not causing the ejection of the droplet to generate 1 drop when forming a record of 1 dot (pixel).

Further, in the embodiments described above, there is explained the case in which the positive pulse signal is the expansion pulse signal. However, the expansion pulse signal can also be a negative pulse signal providing the capacity of the liquid ejection channel 45A is substantively expanded. Similarly, the contraction pulse signal can also be a positive pulse signal providing the capacity of the liquid ejection channel 45A is substantively contracted.

Further, in the embodiments described above, the control circuit 35 varies the crest value of either one of the positive pulse signals other than the positive pulse signal to be applied at the end in the drive waveform to thereby vary the ejection volume of the ink. However, besides the above, it is also possible to vary the crest values of two or more positive pulse signals as long as the positive pulse signals are not the positive pulse signal to be applied at the end.

It should be noted that it is also possible to realize the whole or a part of the function of each of the sections provided to the control circuit 35 in the embodiments described above by recording the program for realizing the functions on a computer-readable recording medium, and then making the computer system retrieve and then execute the program recorded on the recording medium. It should be noted that the "computer system" mentioned here should include an OS and the hardware such as peripheral devices.

Further, the "computer-readable recording medium" denotes a portable recording medium such as a flexible disk, a magneto-optical disk, a ROM, and a CD-ROM, and a storage section such as a hard disk incorporated in the computer system. Further, the "computer-readable recording medium" can include those dynamically holding a program for a short period of time such as a communication line in the case of transmitting the program via a network such as the Internet or a communication line such as a telephone line, and those holding a program for a certain period of time such as a volatile memory in a computer system functioning as a server or a client in that occasion. Further, the program described above can be those for partially realizing the functions described above, or those capable of realizing the functions described above in combination with a program having already been recorded on the computer system.

Further, the control circuit 35 in the embodiments described above can also be realized as an integrated circuit such as an LSI (Large Scale Integration). Further, for example, the control circuit 35 can also be integrated as a processor. Further, the method of the circuit integration is not limited to LSI, but the circuit can be realized by a dedicated circuit or a general-purpose processor. Further, in the case in which a technology of the circuit integration replacing the LSI appears due to the advance in semiconductor technology, it is also possible to use an integrated circuit derived from such a technology.

What is claimed is:

1. A liquid jet head comprising:

a plurality of nozzles adapted to jet a liquid;

a piezoelectric actuator having a plurality of pressure chambers corresponding respectively to the nozzles and filled with the liquid, and adapted to vary a capacity of each of the pressure chambers; and a control section adapted to apply a pulse signal to the piezoelectric actuator to thereby expand and contract the capacity of the pressure chamber so as to jet the liquid with which the pressure chamber is filled, wherein the control section generates a drive waveform including a plurality of the pulse signals adapted to expand the capacity of the pressure chamber, and sets a single crest value of either of the pulse signals other than the pulse signal applied last to a different value from crest values of the other pulse signals in the drive waveform, the crest values of the other pulse signals being identical.

2. The liquid jet head according to claim 1, wherein the control section sets the crest value of either one of the pulse signals to the different value from the crest value of the other of the pulse signals in the drive waveform.

3. The liquid jet head according to claim 1, wherein the control section sets the crest values of two or more of the pulse signals to different values from the crest value of the other of the pulse signals in the drive waveform.

4. The liquid jet head according to claim 1, wherein the control section sets the crest value of the pulse signal applied first to the different value from the crest value of the other of the pulse signals in the drive waveform.

5. The liquid jet head according to claim 1, wherein the control section applies a pulse signal adapted to contract the capacity of the pressure chamber at an end of the drive waveform.

6. A liquid jet recording device comprising:
the liquid jet head according to claim 1.

7. A liquid jet head drive method comprising:
providing a liquid jet head including
a plurality of nozzles adapted to jet a liquid,
a piezoelectric actuator having a plurality of pressure chambers corresponding respectively to the nozzles and filled with the liquid, and adapted to vary a capacity of each of the pressure chambers, and
a control section adapted to apply a pulse signal to the piezoelectric actuator to thereby expand and contract the capacity of the pressure chamber so as to jet the liquid with which the pressure chamber is filled;
generating, by the control section, a drive waveform including a plurality of the pulse signals adapted to expand the capacity of the pressure chamber;
setting, by the control section, a single crest value of either of the pulse signals other than the pulse signal applied last to a different value from crest values of the other pulse signals in the drive waveform, the crest values of the other pulse signals being identical; and
applying, by the control section, a last pulse signal of the drive waveform.

* * * * *